US006019401A

United States Patent [19]

Prevot et al.

[11] Patent Number: 6,019,401

[45] Date of Patent: Feb. 1, 2000

[54] LOCK FOR SLIDING CLOSURE

[75] Inventors: Gérard Prevot, Willerwald; Gérard Desplantes, Sarrebourg; Eric Alvarez, Hommert, all of France

[73] Assignee: Ferco International Ferrures Et Serrures De Batiment, Reding, France

[21] Appl. No.: 09/054,906

[22] Filed: Apr. 3, 1998

[30] Foreign Application Priority Data

Apr. 3, 1997 [FR] France ..... 97 04066

[51] Int. Cl.[7] ..... E05C 1/02

[52] U.S. Cl. ..... 292/179; 292/DIG. 46; 292/DIG. 53; 292/106

[58] Field of Search ..... 292/121, DIG. 46, 292/129, 106, 179, 150, DIG. 37, 177, DIG. 20, DIG. 31, DIG. 53, DIG. 54

[56] References Cited

U.S. PATENT DOCUMENTS

| | | | |
|---|---|---|---|
| 3,120,748 | 2/1964 | Rechberg | 70/100 |
| 3,173,716 | 3/1965 | Silvers | 292/147 |
| 3,405,961 | 10/1968 | Sanders | 292/207 |
| 3,918,750 | 11/1975 | Okamoto | 292/106 |
| 5,201,557 | 4/1993 | Schlack | 292/161 |
| 5,421,627 | 6/1995 | Yane | 292/162 |
| 5,511,833 | 4/1996 | Tashman et al. | 292/145 |
| 5,740,849 | 4/1998 | Tashman | 160/102 |

FOREIGN PATENT DOCUMENTS

| | | |
|---|---|---|
| 0 389 447 | 9/1990 | European Pat. Off. . |
| 0 220 999 | 5/1987 | France . |
| 2 590 309 | 5/1987 | France . |
| 2 591 267 | 6/1987 | France . |
| 2 712 337 | 5/1995 | France . |

*Primary Examiner*—Darnell M. Boucher
*Assistant Examiner*—Clifford B Vaterlaus
*Attorney, Agent, or Firm*—Kenyon & Kenyon

[57] ABSTRACT

In a lock for sliding closures a covering plate forms an integral part of a sliding assembly. Fixing members include arrangements to receive complementary arrangements of the covering plate and to cooperate with the latter to guide the moving assembly when it slides relative to the wall and to hold it against the wall.

12 Claims, 2 Drawing Sheets

IX
IX

LOCK FOR SLIDING CLOSURE

BACKGROUND OF THE INVENTION

1. Field of the Invention

The present invention concerns a lock for sliding door, window or like closures.

2. Description of the Prior Art

There are many types of lock for sliding closures. For each type of lock the problem arises of fixing the lock to the closure so that it cannot be tampered with from outside the closure.

Some prior art locks comprise two casings disposed on respective opposite sides of the closure. To prevent removal of the lock from the outside the outside casing has tubular projections that project inwards and are internally screwthreaded to receive screws inserted through a hole in the inside casing. These locks are costly.

Other prior art locks for sliding closures comprise a single casing inserted into a slot in the inside front face of the stile of the closure. To fix this casing to the transverse edges of the slot the transverse edges are clamped between covering embellisher plate for the casing covering the edges of the slot and a fixing member inserted into the slot with the casing and moved towards the covering plate by means of a screw passing through said plate.

A sliding assembly comprising a bolt and a member for maneuvering the sliding assembly is inserted into the casing before the casing is inserted into the slot in the closure.

Such locks are satisfactory in terms of reliability, maneuverability and security against external tampering. From the esthetic point of view the covering plate covers the slot in the closure entirely and conceals it. It can have a peripheral contour of any shape and style. However, these locks are relatively complex and costly.

The aim of the present invention is to remedy the drawbacks of the locks of the aforementioned type and to propose a lock of this type that is particularly simple and economical but totally reliable and complies with all security criteria in respect of tampering.

SUMMARY OF THE INVENTION

A lock for sliding door, window or like closures in accordance with the present invention comprises a sliding assembly mobile in the longitudinal direction of a longitudinal slot on a wall on the inside of the closure between a locked position and an unlocked position and including a maneuvering member for moving the sliding assembly from the external face of the wall, two fixing members including means for fixing the lock to respective transverse edges of the slot and a covering plate adapted to cover the edges of the slot wherein the covering plate forms an integral part of the sliding assembly, and wherein the two fixing members include means adapted to receive complementary means of the covering plate, to cooperate with the complementary means to guide the sliding assembly when it slides relative to the wall and to hold the covering plate against the wall.

This eliminates the standard casing of prior art locks, simplifying the lock and the means for fixing it to the closure.

The sliding assembly including the covering plate therefore slides relative to the wall of the closure in the longitudinal direction of the slot. The sliding assembly is guided by the fixing members when it slides relative to the wall of the closure and the covering plate is held against this wall by these members. The fixing members are adapted to receive the complementary means of the covering plate to enable the lock to be fitted to the slot in the closure.

This achieves a particularly simple and economic structure that is also reliable because of the small number of component parts.

In a preferred version of the present invention at least one of the fixing members includes means for immobilizing the covering plate in its locked position and means for releasing said covering plate to move it away from the locked position.

Other features and advantages of the present invention will become apparent from the following detailed description given by way of non-limiting example only with reference to the appended drawings.

DETAILED DESCRIPTION OF THE PREFERRED EMBODIMENTS

Figures 1, 2, 5, 6:
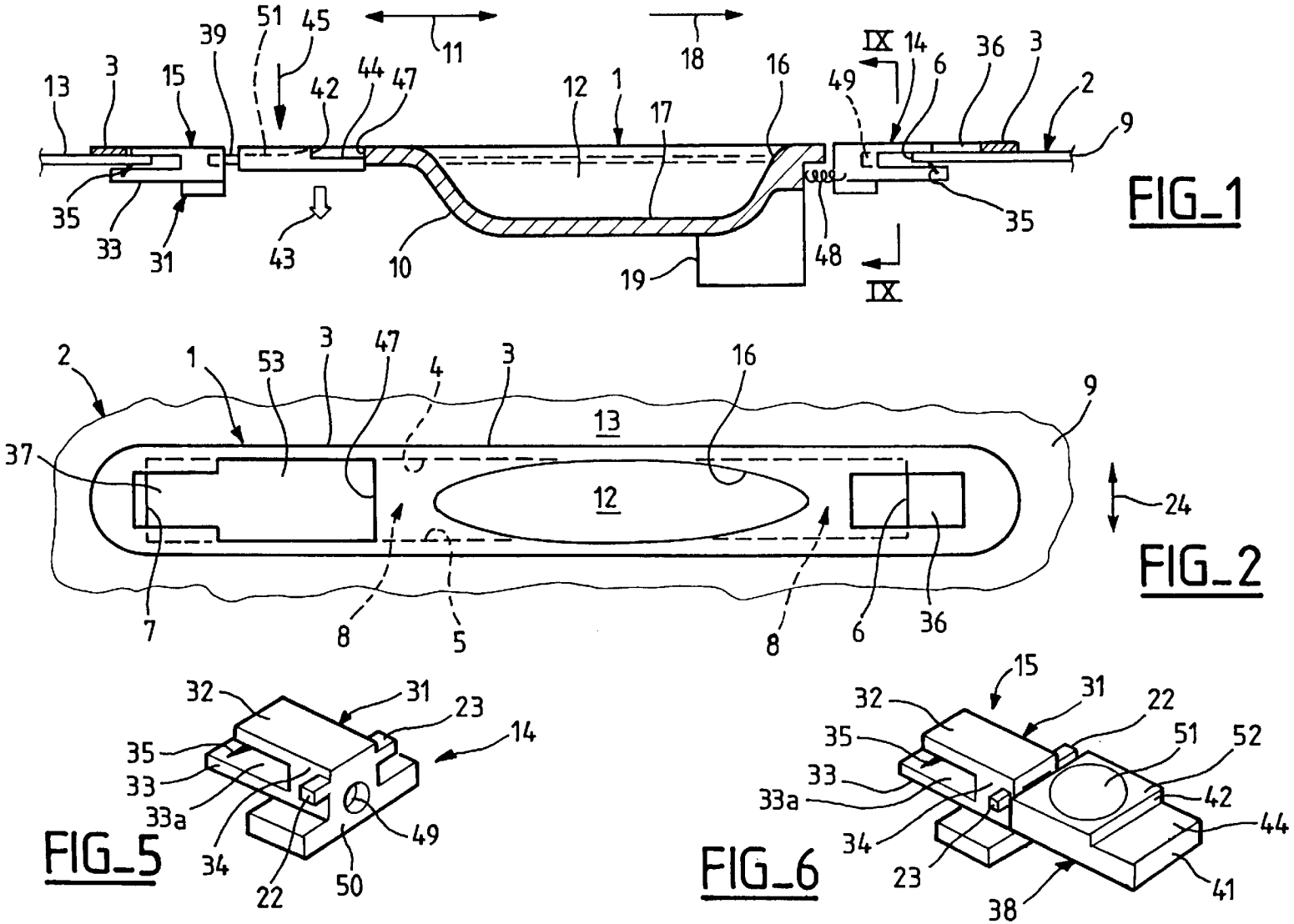
FIG. 1 is a view in longitudinal section of a lock constituting one embodiment of the present invention showing the slider assembly in the locked position.
FIG. 2 is a top view of the lock from FIG. 1, omitting the fixing members for the sake of clarity.
FIG. 5 is a perspective view of the first fixing member of the FIG. 1 embodiment.
FIG. 6 is a perspective view of the second fixing member of the FIG. 1 embodiment.
Figures 3, 4, 7, 8, 9:
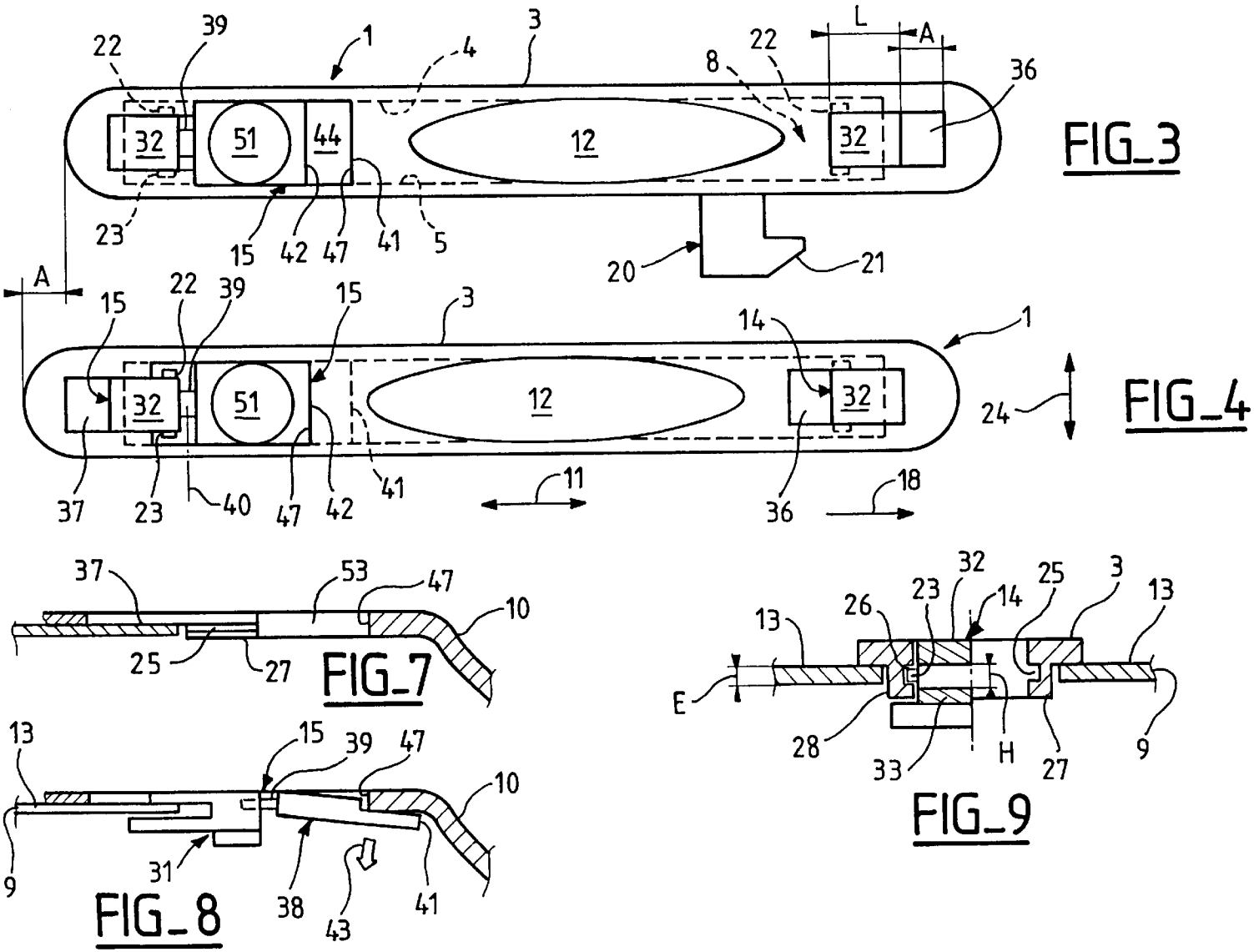
FIG. 3 is a top view of the lock from FIG. 1 showing the covering plate in its locked position.
FIG. 4 is a view similar to FIG. 3 showing the covering plate in its unlocked position.
FIG. 7 is a view to a larger scale of a detail from FIG. 1 omitting the second fixing member for the sake of clarity and showing the covering plate in its unlocked position
FIG. 8 is a view similar to FIG. 7 showing the related member of the second fixing member in its inwardly pivoted position corresponding to the unlocked position of the covering plate.
FIG. 9 is a diagrammatic view in section taken along the line IX—IX in FIG. 1 omitting the fixing member in the righthand half-view.

In the embodiment shown in the figures the lock 1 for sliding door, window or like closures 2 includes a sliding assembly 10 mobile in the longitudinal direction 11 of a longitudinal slot 8 in a wall 9 that is the inside front face of a stile of the closure 2 between a locked position shown in FIGS. 1 and 3 and an unlocked position shown in FIGS. 4, 7 and 8 and including a recess forming a maneuvering member 12 for moving the sliding assembly 10 from the external face 13 of the wall 9.

The lock 1 also includes two fixing members 14, 15 including means for fixing the lock 1 to respective transverse edges 6, 7 of the slot 8.

In accordance with the present invention the lock 1 includes a covering embellisher plate 3 adapted to cover the longitudinal edges 4, 5 and the transverse edges 6, 7 of said slot 8 and forming an integral part of the sliding assembly 10 and the fixing members 14, 15 include means adapted to receive complementary means of the covering plate 3 and to cooperate with said complementary means to guide the covering plate 3 when it slides relative to the wall 9 and to hold the covering plate 3 against the wall 9.

In the conventional way the recess forming the operating member 12 is a cavity extending inwards and obtained in any way, for example by molding or pressing, delimiting a slot 16 in the covering plate 3 into which the fingers can be inserted to press on the back 17 of the cavity in order to move the sliding assembly 10 formed of the maneuvering member 12 and the covering plate 3 in the longitudinal direction 11, either in the locking direction 18, i.e. towards the right in FIGS. 1 to 4, or in the opposite unlocking direction.

In the conventional way this sliding assembly 10 carries a bolt-carrier 19 which in this example is at the leading end of the sliding assembly 10 in terms of the locking direction 18. The bolt-carrier 19 is of any type and is adapted to carry a bolt 20 of any type including a hook 21 extending in the locking direction 18 a distance substantially equal to the distance A between the unlocked and locked positions of the covering plate (see FIGS. 3 and 4).

As shown in detail in FIGS. 5, 6 and 9 the means for guiding the covering plate 3 include, for each fixing member 14, 15, two tenons 22, 23 projecting opposite ways in the transverse direction 24 of the slot 8 on the respective corresponding fixing member 14, 15 and grooves 25, 26 on the bottom of the covering plate 3 extending in the longitudinal direction 11 and each adapted to receive a respective tenon 22, 23.

The tenons could be on the covering plate and the grooves on the fixing members.

FIGS. 3 and 4 show the width of fixing members 14, 15 between the tenons 22, 23 is less than the width of the slot 8 to enable two longitudinal edges 27, 28 attached to the plate plate 3 and bearing respective grooves 25, 26 to be inserted between the fixing member 14, 15 and the longitudinal edges 4, 5 of the slot 8.

In the example shown in the figures and in particular in FIGS. 5 and 6 each fixing member 14, 15 comprises a U-shape main member 31 forming a jaw and having an external flange 32 and an internal flange 33 extending, when said member 14, 15 is engaged with the wall 9, in the longitudinal direction of the slot 8 from the same side of a transverse core 34 and adapted to be placed with one flange 32 on the external side and the other flange 33 on the internal side of the wall 9 of the closure 2.

As can be seen in FIGS. 1, 8 and 9 in particular the height H between the flanges 32 and 33 is greater than the thickness E of the wall 9 (see FIG. 9).

These figures also show a leaf spring 35 fixed to the face of one flange 32, 33 facing the wall 9, in this example the face 33*a* of the internal flange 33. The leaf spring 35 is inclined to the wall 9 to allow the flanges 32, 33 of the corresponding fixing member 14, 15 to be inserted on respective opposite sides of the corresponding transverse edge 6, 7 of the wall 9 and to oppose movement of said member 14, 15 in the opposite direction.

If the wall 9 is made from aluminum or light alloy the leaf spring 35 is made from stainless steel, for example, so as to be able to bite into the metal of the wall 9 when the corresponding fixing member is in place on respective opposite sides of the respective transverse edge 6, 7: in this way the leaf spring 35 is able to oppose movement of said member 14, 15 in the direction opposite the insertion direction, i.e. in the direction in which the leaf spring 35 is inclined relative to the wall 9.

The covering plate 3 includes two slots 36, 37 extending longitudinally and adapted to receive in sliding fashion the external flange 32 of the corresponding fixing member 14, 15.

It can therefore be seen that the length of the slots 36, 37 in the longitudinal direction 11 is equal to the sum of the length L in the longitudinal direction of the external flange 32 and the sliding travel A of the covering plate 3 relative to the wall 9 (see FIG. 3).

At least one of the fixing members 14, 15 (here the member 15) includes means for immobilizing the covering plate 3 in its locked position and means for releasing said covering plate 3 to move it away from the locked position.

In the present example the second fixing member 15 at the trailing end in terms of the locking direction 18 includes a related member 38 extending longitudinally relative to the member 15, connected to said member 15 and carrying means for immobilizing the covering plate 3 relative to the wall 9.

The related member 38 extends in the locking direction 18 relative to the member 15 and includes two abutment members 41, 42 separated from each other in the longitudinal direction 11 by a distance equal to the sliding travel A of the covering plate 3 relative to the wall 9 and adapted to abut against the edge surface 47 constituting the first edge, in the locking direction 18, of the slot 37, respectively the member 41 in the locked position of the covering plate 3 shown in FIGS. 1 and 3, the related member 38 being in a first position, shown in these figures, and the other member 42 in the unlocked position of the outside plate 3 shown in FIGS. 4 and 8 after said related member 38 pivots in the direction of the arrow 43 (FIGS. 1 and 8) towards a second pivoted position of said related member 38 shown in FIG. 8.

The related member 38 is connected to the second fixing member 15 by a leaf spring 39 providing a hinge with an axis 40 (FIG. 4) extending in the transverse direction 24 of the slot 8, the leaf spring 39 extending parallel to the flanges 32, 33 of said fixing member 15.

In the locked position of the covering plate 3 the related member 38 is in its raised first position in which the member 41 engages the edge surface 47 (see FIGS. 1 and 3).

In the unlocked position of the plate 3 the member 38 is in its pivoted second position in which the member 42 engages the edge surface 47 (see FIGS. 4 and 8).

The figures show that the related member 38 is in the form of a plate extending parallel to the wall 9 when the second fixing member 15 is in position on said wall 9. The external face 44 of the related member 38 is stepped on the side opposite the hinge 39 to form two edge surfaces 41, 42 adapted to engage the edge surface 47 of the second slot 37. The first edge surface 41 corresponds to the free edge of the related member 38 and engages the edge surface 47 in the immobilized locked position of the covering plate 3 shown in FIGS. 1 and 3. The second edge surface 42 corresponds to the step on the face 44 and engages the edge surface 47 in the unlocked position of the covering plate 3 shown in FIGS. 4 and 8 after the related member 38 has pivoted in the direction 43 towards the internal side of the closure 2 due to pressure in this direction 43 exerted on the external face 44 of said member 38 and symbolized by the arrow 43 in FIG. 1.

To facilitate release the related member 38 has a width in the transverse direction 24 equal to the width of the slot 8, which is the maximal possible width.

Similarly, a concave imprint 51 to facilitate application of the finger is provided on the part 52 of the external face 44 between the hinge 39 and the edge surface 42.

Accordingly, the slot 37 has at its leading end in terms of the locking direction 18 an enlarged part 53 through which the related member 38 passes and which is delimited in the locking direction by the edge surface 47.

Spring means 48 are provided between the covering plate 3 and the one of the fixing members 14, 15 (here the member 14) to spring-load the plate 3 in the direction opposite the locking direction 18.

Accordingly, as soon as the edge surface 41 is released from the edge surface 47 by applying pressure in the direction of the arrow 45 to the imprint 51 on the related member 38 the spring 48 moves the covering plate 3 in the direction that releases it. It is easy to size the spring 48 so that this movement extends as far as the unlocked position of the covering plate 3 shown in FIGS. 4 and 8.

As shown in FIG. 5 there is advantageously a hole 49 in the transverse face 50 of the first fixing member 14 to provide a base for the spring 48 (see FIG. 5). An equivalent hole, not shown, is advantageously provided in the facing face of the sliding assembly 10.

For the purpose of inserting and positioning the sliding assembly 10 including the covering plate 3 and the fixing members 14, 15 into the slot 8 the fixing members 14, 15 can pivot slightly around the edge of the leaf spring 35 engaged with the wall 9 to facilitate insertion of the tenons 22, 23 into the grooves 25, 26.

The process starts with the member 14: the top flange 32 is inserted into the slot 36 and then the member 14 is inserted to straddle the edge 6 of the slot 8. The covering plate 3 is placed in its locked position.

The member 15 is then inserted into the enlarged part 53 of the slot 37, the covering plate 3 is placed on the wall 9 and the member 15 is inserted to straddle the edge 7, the related member 38 being raised outwardly relative to the member 15 so as not to impede the above operation.

Alternatively, the fixing members 14, 15 are first fixed to the sliding assembly 10 after which said sliding assembly 10 is fixed by clipping it to the edges of the slot 8.

To facilitate this insertion the tenons 22, 23 advantageously have one of their faces parallel to the flange 32, 33 inclined to form a slope or ramp (not shown) facilitating insertion of the tenons 22, 23 into the grooves 25, 26.

A lock structure has thus been described that is particularly simple, suitable for very economic manufacture in plastics material. In particular, inserting the leaf springs 35 and 39 is very easy in a plastics material implementation.

In this structure the conventional casing having an embellisher plate in one piece with the casing is reduced to the embellisher plate alone which also serves the function of the conventional slider consisting of a one-piece maneuvering member and a bolt-carrier.

This structure can be fitted simply and quickly into the slot 8, locating accurately despite the simplicity of the means employed.

Of course, the present invention is not limited to the embodiment just described and many changes and modifications can be made to the latter without departing from the field of the invention.

The slot 36 or 37 can easily be used as a means of indicating the position of the covering plate 3, to expose appropriate colored areas on one side or the other of the flange 32 of the member 14.

The related member 38 is connected to the second fixing member 15 by a hinge member 39.

What is claimed is:

1. A lock for attachment to a sliding closure comprising a sliding assembly adapted to be introduced through and mobile in a longitudinal direction of a longitudinal slot having longitudinal and transverse edges in a wall forming an inside front face of a stile of the sliding closure between a locked position and an unlocked position and including a bolt carrier and a maneuvering member for moving said sliding assembly from an external face of the wall, said lock further comprising a covering plate adapted to cover the slot and the longitudinal and transverse edges of the slot and a first and a second fixing member each including means for fixing said covering plate to respective transverse edges of the slot, wherein said covering plate forms an integral part of said sliding assembly and slides therewith, and wherein said first and second fixing members include guiding means adapted to receive complementary guiding means of said covering plate, to cooperate with said complementary guiding means to guide said covering plate when said covering plate slides relative to the wall and to hold said covering plate against the wall.

2. The lock as claimed in claim 1 wherein said guiding means for guiding said covering plate include, for each of said first and second fixing members, two tenons projecting opposite ways in a transverse direction of the slot and wherein said complementary guiding means include two grooves on a bottom of said covering plate, said grooves extending in the longitudinal direction and wherein each of said grooves is adapted to receive within it one of said tenons.

3. The lock as claimed in claim 1 wherein each of said first and second fixing members includes a U-shape member having an external flange and an internal flange extending, when said U-shape member is engaged with the wall, in the longitudinal direction of the slot from a same side of a transverse core and wherein said external flange is placed on an external side of the wall of the slot and said internal flange is placed on an internal side of the wall of slot.

4. The lock as claimed in claim 3 wherein a height between said external and internal flanges is greater than a thickness of the wall.

5. The lock as claimed in claim 4 wherein a leaf spring is fixed to a face of one of said external and internal flanges and facing the wall and is inclined in a direction relative to the wall to allow insertion of said flanges of the corresponding fixing member on respective opposite sides of a transverse edge corresponding to the wall and to oppose movement of said corresponding fixing member in an opposite direction to the inclined direction of said leaf spring.

6. The lock as claimed in claim 3 wherein said covering plate includes a first and a second slot extending longitudinally and wherein each slot is adapted to receive in sliding fashion said external flange of a corresponding fixing member.

7. The lock as claimed in claim 1 wherein at least one of said fixing members includes means for immobilizing said covering plate when it is in said locked position and means for releasing said covering plate in order to move said covering plate away from said locked position.

8. The lock as claimed in claim 7 wherein said at least one of said fixing members includes at a trailing end, in terms of a locking direction, a related member extending longitudinally relative to said at least one of said fixing members and carrying means for immobilizing said covering plate relative to the wall.

9. The lock as claimed in claim 8 wherein said related member extends in said locking direction relative to said at least one of said fixing members and includes first and second abutment members separated from each other in said longitudinal direction by a distance equal to a sliding travel distance of said covering plate relative to the wall and adapted to abut against an edge surface constituting a first edge, which is a leading edge in terms of said locking direction, of a slot in said covering plate, said first abutment member abutting said first edge when said covering plate is in said locked position and said second abutment member abutting said first edge when said covering plate is in said unlocked position.

10. The lock as claimed in claim 9 wherein said related member is connected to said at least one of said fixing members by a hinge member defining a hinge axis extending in the transverse direction of the slot of the wall and wherein in said locked position of said covering plate said related member is in a first position in which said first abutment member engages said first edge and in said unlocked position of said covering plate said related member is in a pivoted second position in which said second abutment member engages said first edge.

11. The lock as claimed in claim 9 wherein said related member is in the form of a plate extending parallel to the wall when said at least one of said fixing members is in position on the wall and wherein an external face of said related member includes a step to form first and second edge surfaces adapted to engage said first edge of said slot in said covering plate, said first edge surface corresponding to a free edge of said related member and engaging said first edge when said covering plate is in said immobilized locked position and said related member being in an outwardly raised position, and said second edge surface corresponding to the step on said external face and engaging said first edge when said covering plate is in said unlocked position and said related member being in a pivoted position towards an internal side of the closure after pressure is applied to said external face of said related member.

12. The lock as claimed in claim 1 further comprising spring means disposed between said sliding assembly and one of said fixing members for spring-loading said sliding assembly in a direction opposite a locking direction.

* * * * *

UNITED STATES PATENT AND TRADEMARK OFFICE

CERTIFICATE OF CORRECTION

PATENT NO. : 6,019,401
DATED : February 1, 2000
INVENTOR(S) : Gerard Prevot et al.

It is certified that error appears in the above-identified patent and that said Letters Patent is hereby corrected as shown below:

Column 1:
Line 22, after "between" insert --a--

Column 4:
Line 26, change "outside plate" to --covering plate--

Signed and Sealed this

Twelfth Day of June, 2001

Nicholas P. Godici

*Attest:*

*Attesting Officer*

NICHOLAS P. GODICI
*Acting Director of the United States Patent and Trademark Office*